United States Patent [19]

Godar

[11] Patent Number: 4,695,492

[45] Date of Patent: Sep. 22, 1987

[54] FORMING LUBRICANT FOR A COATED METAL CONTAINER AND METHOD OF MAKING THE SAME

[75] Inventor: Joseph L. Godar, Wauconda, Ill.

[73] Assignee: American Can Company, Greenwich, Conn.

[21] Appl. No.: 790,698

[22] Filed: Oct. 23, 1985

[51] Int. Cl.[4] ..... B27N 5/02; B21B 45/00; B21J 13/08; B65D 90/04

[52] U.S. Cl. ..... 428/35; 72/46; 72/467; 220/457

[58] Field of Search ..... 428/35; 72/46, 47, 467; 220/457

[56] References Cited

U.S. PATENT DOCUMENTS

| | | | |
|---|---|---|---|
| 3,058,913 | 10/1962 | Koch et al. . | |
| 3,639,316 | 2/1972 | Argiro | 260/22 R |
| 3,826,675 | 7/1974 | Smith et al. | 117/75 |
| 3,923,471 | 12/1975 | Smith et al. | 29/195 |
| 3,926,885 | 12/1975 | Keil | 260/29.15 B |
| 3,941,910 | 3/1976 | Asano et al. | 428/457 |
| 4,032,678 | 6/1977 | Perfetti et al. | 427/388 A |
| 4,060,508 | 11/1977 | Sugahara et al. | 260/23 XA |
| 4,062,312 | 12/1977 | Mason | 72/46 |
| 4,148,970 | 4/1979 | McIntosh et al. | 428/469 |
| 4,177,323 | 12/1979 | Ohi et al. | 428/622 |
| 4,208,471 | 6/1980 | Bresak | 428/447 |
| 4,237,188 | 12/1980 | Hoke | 428/418 |
| 4,256,594 | 3/1981 | Rysek | 252/49.9 |
| 4,287,109 | 9/1981 | Schlak et al. | 260/29.2 M |
| 4,287,741 | 9/1981 | Peters et al. | 72/42 |
| 4,336,150 | 6/1982 | Dorrell | 252/56 R |
| 4,477,501 | 10/1984 | Kojima et al. | 428/35 |
| 4,507,339 | 3/1985 | Carbo et al. | 428/35 |
| 4,522,049 | 6/1985 | Cloues | 72/46 |
| 4,637,117 | 1/1987 | Karas et al. | 29/527.4 |

FOREIGN PATENT DOCUMENTS

| | | |
|---|---|---|
| 1058454 | 7/1979 | Canada . |
| 092502 | 2/1977 | Japan . |
| 8001361 | 4/1981 | PCT Int'l Appl. . |

*Primary Examiner*—John E. Kittle
*Assistant Examiner*—Patrick J. Ryan
*Attorney, Agent, or Firm*—Ernestine C. Bartlett

[57] ABSTRACT

A metal container comprising a seamless body and an end wall integral therewith and having on at least its interior surface a protective coating which consists of a modified butyl stearate utilized as a lubricant in forming the container and an after-applied synthetic resin.

18 Claims, No Drawings

FORMING LUBRICANT FOR A COATED METAL CONTAINER AND METHOD OF MAKING THE SAME

This is a continuation of application Ser. No. 519,236, filed Aug. 2, 1983 now abandoned.

BACKGROUND OF THE INVENTION

The well known three-piece sheet metal food container is fast being supplemented by a two-piece container having a seamless body with one end wall integral with the body and the other end wall secured to the body by means of a double seam after filling the container. Such containers for beer and soft drinks are made by the drawing and ironing process; whereas containers for fruits and vegetables which require a heavier and sturdier side wall are beginning to be made by a newer process known as draw/redraw.

Although the production of sheet metal containers by means of multiple draws is not new, the draw/redraw process is an improvement over the older drawing process in that it is done at higher speeds with greater draw ratios in each drawing step. Achieving this higher productivity rate requires special machines and, inter alia, special lubricants for the metal working operation; and to maintain this higher productivity rate, subsequent processing steps to the formed container must also be at high speed or eliminated where possible.

Butyl stearates have been used as rolling lubricant in steel mills and as lubricant for aiding in the mobility of synthetic fiber manufacture. Butyl stearate has been used for intricate metal forming operations such as bending tabs and necking and flanging can body ends, but has not been used for deep drawing. The need for butyl stearates in connection with particular precoating materials for can manufacture has not been appreciated.

SUMMARY OF THE INVENTION

The present invention involves the discovery that the butyl stearates not only act as an effective lubricant in the drawing and redrawing of ferrous metal stock to form a container but that these lubricants when modified, unlike metal-working lubricants used heretofore, need not be removed from the surface of the formed container and may be used with vinyl based coatings without concern for the deterioration of same. Specifically, other lubricants useful as a compatible postcoatable draw/redraw lubricant have a plasticizing effect on the vinyl based coatings causing softening. In particular, an ATBC being a citric acid ester when used with a polyester or vinyl base coating will soften same. The softened coating will scuff during the draw/redraw forming process. Coating damage is unacceptable since the coating must provide a complete barrier between the food and the metal container body.

The type of butyl stearate which works well is manufactured by C. P. Hall under their designation UNIFLEX BYS-Code C and has the following structural formula:

$$C_{17}H_{35}-\overset{\overset{\displaystyle O}{\|}}{C}-O-C_4H_9$$

The method of the present invention has been found equally applicable for tinplated ferrous metal and for tin-free, low carbon sheet steel. The tinplate referred to in column 2, lines 50–56 of U.S. Pat. No. 4,287,741 is usable in the present invention, non-reflowed as well as matte finish tinplate described in U.S. Pat. No. 3,360,157. The tin weight on the steel basis metal may vary from 0.05 lbs to 1.00 lbs. per base box. A base box being 31,360 sq. in. of metal plate (on one side).

The preferred tin-free steel has a chromium surface treatment. While it is still in flat sheet form prior to its formation into a container, a synthetic resin base coat is applied and adhered to this treated surface. The most usual compositions for application as a base coat are those containing an epoxy resin or vinyl resin or polyester resin.

DETAILED DESCRIPTION OF THE INVENTION INCLUDING PREFERRED EMBODIMENTS

The tin-free steel preferred for use in the present invention is aluminum-killed, continuous cast steel with a chromium/chromium oxide surface treatment. The chromium in the oxide is present at about 0.5 to 2.0 mg per square foot and the chromium metal at about 3 to 13 mg per square foot. The material described is known in the art as TFS-CT for tin-free steel, chromium type. The treatment is described in a paper published in the *Journal of the Electrochemical Society*, Vol. 116, No. 9, pp 1299–1305.

The preferred tinplate has the same composition of steel as set forth above and at the steel mill in a well known manner, has tin applied to its surface electrolytically in various amounts, for example, 0.25 lb per base box. As mentioned, this tinplate may be left in a matte condition, i.e., is not flow brightened, is oiled for rust inhibition and coiled for shipment to a container-making installation.

Thereafter, the tin-free steel when received in the can making plant has applied to its surfaces a base coating. The preferred coating contains a vinyl resin being a vinyl organosol including low molecular weight vinyl copolymers, high molecular weight vinyl homopolymer dispersion resins and heat reactive cross linking resins to include phenolics, epoxies and aminoplasts. This preferred coating is manufactured by Midland Dexter of Waukegan, Illinois and is identified and sold as MM 519. This coating is known to contain as a primary resin a high molecular weight vinyl dispersion resin and lesser amounts of solution vinyl, polyester, epoxy and melamine resins as modifiers. While MM 519 performs well in the practice of this invention there are situations when other coatings may be preferred. By way of example, another preferred coating is known to be MC 9788-101 sold by Mobil Chemicals. Unlike the MM 519, MC 9788-101 is not a vinyl organosol, instead it is composed of an isophthalic acid based polyester resin that is cured or cross-linked through the action of heat reactive epoxy and melamine resins.

Those base coatings may be applied to both sides of the steel while the steel is still in coil form or the steel may be cut into scrolled sheets and the coating applied to individual sheets, which coating is subsequently baked to form a tough, adherent base coat on the tin-free steel.

The butyl stearate lubricant mixture of the present invention is either electrostatically coated, dip coated or spray coated onto both surfaces of individual sheets of the base coated tin-free steel, the sheets are then fed into a blanking and cupping press which cuts from the sheet one or more circular discs of 7.947 in. in diameter, and draws the disc into a cup of 5.007 in. in diameter and 1.850 inches in side wall height. In two subsequent operations, the cup is successively reduced in diameter with concurrent lengthening of its side wall, i.e., drawn; and simultaneously the side wall is slightly thinned, i.e., to about 10% less than the starting gauge, and further elongated, i.e., ironed, in the manner similar to that described in U.S. Pat. No. 3,360,157. The final diameter and side wall height accomplished in the drawing plus ironing are 3.060 in. and 4.450 in. respectively and are accomplished in a few seconds. The diameter of the starting blank and the height to diameter ratios, draw ratios, in the ensuing metal working process may be varied depending upon the desired size of the finished can. Also, as between different draw/redraw systems, the amount of draw in each step may be varied providing the cumulative effect of the plural draws and with ironing produces the can of desired height and diameter.

The severity of the concurrent diameter reduction and side wall thinning (ironing) requires an excellent lubricant which will not attack the coating. It is readily apparent that a draw/redraw system with ironing is a more severe metal working process than a draw/redraw system without ironing. The butyl stearate lubricant of the present invention performs equally well in both systems.

The amount of lubricant applied over the base coat can vary from 10 to 40 and preferrably 10 to 20 milligrams per square foot of total surface, i.e., both sides, of the sheet being fed into the draw/redraw apparatus. It has been found that the lubricating effect falls off appreciably below 10 mgs/ft$^2$ and for most operations 20 mgs/ft$^2$ is sufficient to achieve the high speed, trouble free, multiple draws from flat blank to formed container. Substantial heat is generated on the surfaces being worked due to the severity of the metal-working operation, i.e., the appreciable draw ratios and draw speed plus ironing. No particular theory is known as to why the butyl stearate lubricant is compatible for postcoating without need for removal of same. Other lubricating materials have under identical conditions been known to attack the base coating as already described. Moreover, the severe metal forming operations of precoated sheet at high speed and pressure could drive the lubricant into the coating and so a lubricant which is compatible with the coating even under such conditions is needed.

Certain silicone resins such as General Electric's SR 82 are known for their ability to modify coatings and thereby enhance their bond with a metal substrate to which they are applied, but, the addition of silicone resin such as General Electric's SR 82 to butyl stearate to permit subsequently applied coatings (after forming) to cover the surface of the metal substrate completely was not appreciated. That is to say that, the addition of silicone resin to the butyl stearate allows complete coverage of all portions of metal substrates by coatings applied after forming without leaving eye holes or discontinuities in the coverage or without any tendencies for the postcoating to bead up. The affect without silicone resin is much like water on freshly waxed surfaces. The addition of silicone resin permits a wetting action and alters the surface tension of the butyl stearate sufficiently to allow the coatings as applied to spread evenly and completely over the lubricated metal substrate and to form a good bond across the entire surface. The proposed combination of silicone resin and butyl stearate when preapplied to coils or panels of tin free steel plate, electrolytic tinplate or other materials for deep drawing containers or cup-like objects which are intended to be post sprayed or post decorated performs successfully because of the bonding and good adherence of the wettable combination to the lubricated metal surface.

COMPATIBILITY LUBE—WETTABILITY TEST

Ingredients which have good lubricating properties, were tested for compatibility with the postsprayed top coat.

The test procedure consisted of wiping a thin film of the lubricant on a piece of base coated plate (the lubricant was applied at a weight of about 50 to 75 mgs sq. ft.). A water base top coating was then sprayed over the lubricant plate. These panels were allowed to stay at room temperature for at least 15 minutes to see if the coating would de-wet from the lubricant treated area.

The results with the various lubricants tried were as follows:

1. Butyl stearate—no de-wetting.
2. Liquid lanolin—very slight de-wetting.
3. SR-882—no de-wetting
4. Petrolatum—severe de-wetting.

Using this test procedure combinations of the lubricants listed were tried and when these ingredients are blended at the proper ratios (not petrolatum) no de-wetting of the spray top coat occurred.

For sheet feeding the mixture must have less than 50% liquid lanolin because it makes adjacent sheets stick together when the lanolin is applied at heavier rates. For coil stock or prelube spot coating the liquid lanolin level may be increased beyond the 50%.

DISCUSSION OF THE VARIOUS LUBRICANTS

While butyl stearate is a lubricant it is really inadequate for the heavy loads in draw and redraw forming operations. Enhanced lubricity can be had by the addition of liquid lanolin but use of same without reduction of its viscosity with butyl stearate makes difficult the application at the mentioned rates. The use of only butyl stearate will not be adequate to lubricate the material as same is drawn and redrawn. Conversely, the use of only liquid lanolin would be a problem because of its viscosity. Therefore, the combination of butyl stearate and liquid lanolin are important.

There may also be a need for something which will allow the combination to be postcoated. If lubrication were the only requirement and a complete coverage of the metal surface were not necessary, the drawing tools might tend to spread whatever lubricant is available. The postcoating of lubricant could be affected by the build-up of the lube on the tools. That is the lube would be sufficient to lubricate for the forming process but the material might be slightly over lubricated in certain areas. The additional wetting provided by General Electric's SR 82 silicone resin is necessary to provide sufficient wettability to the metallic substrate for the postcoating.

Drawing and redrawing is not the only forming operation the lubricated container must endure. At the completion of the draw/redraw operation, the container is beaded to impart strength to the side and bottom walls before being fed into a device for applying a top coat to the container's inside surface. Most usually, this device involves a turret which revolves the container past a reciprocating spray gun which enters the interior of the container as same is spun about its longitudinal axis. As the spray gun is retracted from the container body, it emits a 360° spray of a synthetic resin solution to coat the entire interior surface of the container.

After completion of the top coating operation, the container is then subjected to a temperature of 400° F. for 2 to 4 minutes to harden and cure the top coat. Unlike prior procedures of metal forming which required the metal working lubricant to be washed to remove it and dried to prepare the container before application of the top coat to thereby avoid contamination and improper curing of the top coat, the procedure of the present invention not only eliminates the expense and time consuming step of removing the lubricant but also permits the application of the top coat directly to a still lubricated surface (the inside of the container). In addition, the wetted lubricant remaining after forming assists in firmly adhereing the top coat to the base coat.

The butyl stearate and what remains thereof after the draw/redraw operation are soluble in organic solvents such as butanol, butyl Cellosolve, di-isobutyl ketone, Cellosolve acetate and Solvesso 150. Therefore, resins for top coats which are also soluble in these same solvents and provide inert, continuous, resin films upon thermal curing are preferred. More particularly, resins such as epoxy resins, acrylic resins and vinyl resins are useful and particularly usable if they are applied over a vinyl base coat and a lubricant which does not attack the vinyl or cause softening.

Evaluation of top coats applied over a butyl stearate lubricated vinyl base coat is done by testing process resistance as well as examination of intercoat adhesion between the base coat and the top coat. Intercoat adhesion is tested with a pressure sensitive adhesive tape. More particularly, a one inch strip of 3M tape #610 is applied to the surface of the top coated sample. The tape is pressed to the surface with sufficient pressure to make complete contact (removing the air bubbles therebetween). The tape test requires that the tape be quickly pulled from the sample in an effort to peel with it any poorly adhering coating. In order to further test peeling, X's are scribed on the surface across which the tape is to be applied. These X's present a freshly made scored edge which would help to initiate any peeling that might occur. The top coats produced in Examples 1 through 5 which follow herein were tested for intercoat adhesion by this method and all passed. No separation of top coat from the compatably lubricated base coat occurred.

Similarly, the continuity of the top coat can be tested by the quick test method. In order to perform a quick test a specific piece of equipment is required. More particularly, a Model 1071 WACO Enamel Rater with a 0 to 1 milliamp attachment is used. The apparatus has an electrode which is adapted to move vertically in and out along the axis of a can positioned beneath it. The electrode is positioned about 1" from the bottom of the can. The can is held in position by a vise-like device which clamps it about the bottom holding it so that the open end of the can faces up toward the electrode. The can is filled with 2% solution of sodium sulfate and allowed to soak for at least 30 seconds before the electrode is dropped into the can. The solution temperature should be maintained between 72° F. to 78° F., and the can should be filled so that when the electrode is lowered into the test position the solution will reach approximately ⅛" below the top flange radius of the can. Care should be taken to avoid wetting the flange since that will result in a false high reading. The milliamp meter of the tester is connected to the vise-like device which holds the bottom of the can. The electrode is connected to another lead of the milliamp meter. A zeroing of the instrument is required and the operator adjusts the milliamp to read "T" on the scale. Shortly after zeroing the meter a warning light comes on and the reading should be taken immediately. When this procedure is applied to properly coated cans readings in the range of 0 to 5 milliamps should be obtained and such data is indicative of an acceptable container.

Consequently, a coating system for a metal substrate which will withstand the severity of multiple forming operations without destruction has been sought. A coating system which functions to protect the metal substrate and prevent corrosion and off flavor is the thrust of this invention.

EXAMPLE 1

A composition designated Formula 29-1 including 40% liquid lanolin made by Kraft and designated Ritalan was mixed with 50% n-butyl stearate made by C. P. Hall and 10% silicone resin with an abundance of hydroxyls made by General Electric and commercially available as SR-82 were mixed together and applied to tin free steel designated TFS-CT which was base coated with 33 mg per 4 square inches of a vinyl coating made by Midland-Dexter and designated MM-519. The base coating was cured at 400° F. for 8 minutes. The composition of Formula 29-1 was applied at a rate of 25 mg per square foot by means of spray.

These samples were tested as follows. The scroll strips did not stick to one another with this formula. Thus, there was adequate viscosity reduction of the lanolin. They feed well and make excellent cans when drawn and redrawn and can be postsprayed over directly without first washing and drying.

EXAMPLE 2

A composition designated Formula 28-1 including 55.55% liquid lanolin made by Kraft and designated Ritalan was mixed with 26.67% n-butyl stearate made by C. P. Hall and 17.78% silicone resin with an abundance of hydroxyls made by General Electric and called SR-82 were mixed together and applied to tin free steel designated TFS-CT which was base coated with 33 mg per 4 square inches of a vinyl coating made by Midland Dexter and designated MM-519. The base coating was cured at 400° F. for 8 minutes. The composition of Formula 28-1 was applied at a rate of 25 mg per square foot by means of spray.

These samples were tested and this formula caused the scroll strips to stick slightly hampering feeding because the lanolin was still to viscous. Good cans were made.

EXAMPLE 3

A composition designated Formula 26-4 including 66% liquid lanolin made by Kraft and designated Ritalan was mixed with 27% n-butyl stearate made by C. P. Hall and 17% silicone resin with an abundance of hydroxyls made by General Electric and called SR-82 were mixed together and applied to tin free steel designated TFS-CT which was base coated with 33 mg per 4 square inches of a vinyl coating made by Midland Dexter and designated MM-519. The base coating was cured at 400° F. for 8 minutes. The composition of Formula 26-4 was applied at a rate of 25 mg per square foot by means of spray.

These samples were tested and this formula did not allow the scroll strips to feed into the press. The high lanolin content made the composition viscous causing the strips to stick together. The lube allowed the cans to form very well.

EXAMPLE 4

A composition designated Formula 29-1 including 40% liquid lanolin made by Kraft and designated Ritalan was mixed with 50% n-butyl stearate made by C. P. Hall and 10% silicone resin with an abundance of hydroxyls made by General Electric and called SR-82 were mixed together and applied to tin free steel designated TFS-CT which was base coated with 33 mg per 4 square inches of a polyester coating made by Mobil and designated MC-9788-101. The base coating was cured at 400° F. for 8 minutes. The composition of Formula 29-1 was applied at a rate of 25 mg per square foot by means of spray.

The samples were tested and excellent cans were made, with no problems of scroll strips sticking together and with good postspray coverage.

EXAMPLE 5

A composition designated Formula 24-10 including 17.17% liquid lanolin made by Kraft and designated Ritalan, 66.99% n-butyl stearate made by C. P. Hall, and 15.84% silicone resin with an abundance of hydroxyls made by General Electric and called SR-82 were mixed together and applied to tinplated steel designated #25 ETP, which was electrolytically coated steel having 0.25 pounds of tin coating per base box. Sample containers were then made from this plate using three draw/redraw steps. The completed cans were then inside post sprayed without removing the residual lubricant after the drawing operations. The spray coating used was an aliphatic hydrocarbon solvent based aluminum pigmented modified epoxy phenolic resin. The post coating was cured at 400° F. for 5½ minutes. The composition of Formula 24-10 was applied at a rate of 20 mg per square foot by means of a dip tank and squeegee metering. There were no fabrication failures during a 2000 can run using plate lubricated with this formula.

The sample containers of Examples 1, 4 and 5 were evaluated by means of a quick test procedure commonly used by can makers to determine the degree of coverage of inside sprayed containers. Quick test readings of zero are desirable, but values up to 5 milliamperes of current flow during the testing procedure are usually considered good. The sample containers tested had a quick test range of 0 to 5, with the average being about 1.5 milliamperes.

A typical container as formed by the draw/redraw process using the lubricant combination of this invention results in a 303×406 two-piece tin plated steel can. The inside diameter of the triple drawn finished container of examples is 3.060", the height is 4.375", and the bottom and sidewall thickness are approximately 0.0083", when the feed stock was 75 #T-4 plate. Tin plate, either TFS-CT tin free steel or electrolytic tinplate having various tin weights deposited on both sides of the plate will perform acceptably.

While the preceding has dealt with various examples and various materials, the invention in its broadest aspect is considered to include any type of silicone resin with liquid lanolin (the viscosity of which is reduced by the butyl stearate) to permit a subsequently applied organic coating to spread evenly over the remaining combination after a deep drawing operation resulting in a good bond to the metal substrate after curing of the coating. For specific applications which require more severe draws and/or thinner post coatings, the amounts of the various constituents in the combination can be varied in order to maintain low costs with a lubricant which will perform successfully. In addition, post coating of all ranges of tin coverage on steel will work successfully with this type of lubricant combination. Lightly precoated tin free steels (TFS-CT) may also be successfully processed into post coatable containers using this invention.

It is understood that the invention is not confined to any particular embodiment described herein as illustrative of the invention but embraces all such modifications thereof as may come within the scope of the following claims.

What is claimed is:

1. The method of forming a coated metal container comprising the steps of applying a modified butyl stearate, liquid lanolin lubricant and a silicone resin to a metal selected from the group consisting of electrolytic tin plate and tinless, low carbon steel, providing a circular flat blank from said metal, drawing said blank into a shallow cup, subjecting said cup to multiple draws in rapid sequence to form said container, applying a vinyl resin coating over the interior of said container and over said lubricant on said container interior and heating said coated container to harden said coating and adhere it to said container interior.

2. The method of claim 1 wherein the side wall of said cup is subjected to ironing during said additional draws whereby the side wall of said container is thinner than the bottom wall of said container.

3. The method of claim 1 wherein a vinyl resin coating is applied to and adhered to said metal prior to the application of said butyl stearate lubricant.

4. In a coated metal container comprising a seamless side wall and a bottom wall integral with said sidewall, said sidewall being substantially the same thickness as or thinner than said bottom wall and the metal of said walls being selected from the group consisting of electrolytic tinplate and precoated tinless low-carbon steel and a hardened coating on the metal surfaces of at least the interior walls of the container, the improvement wherein said hardened coating comprises (1) a coat consisting essentially of a lubricant containing a butyl stearate, liquid lanolin and a silicone resin, said lubricant being compatible with and overcoated with (2) a synthetic resin coating.

5. The metal container of claim 4 wherein said synthetic resin overcoat comprises a resin selected from the group consisting of polyester, acrylic and vinyl resins.

6. The metal container of claim 4 wherein the metal of the container is tin-free steel precoated with a hardened synthetic resin base coat.

7. The metal container of claim 4 wherein the hardened synthetic resin base coat is interposed between said metal surfaces and said hardened coating, which base coat covers and adheres to said metal surfaces, the resin of said base coat being selected from the group consisting of polyester, vinyl, epoxy and acrylic resins.

8. A coated metal container comprising a seamless side wall and a bottom wall integral with said side wall, said side wall being substantially the same thickness as or thinner than said bottom wall and a hardened coating on at least the interior walls of said container, said hardened coating comprising (1) a coat consisting essentially of a lubricant mixture containing butyl stearate, lanolin and a silicone resin which has been applied to metal workpieces from which said container is formed and subjected to metal forming steps and (2) an overcoat of a synthetic resin coating, said lubricant mixture being compatible with said overcoat synthetic resin whereby lubricant mixture present on the container walls after forming of the container is overcoated with said synthetic resin without first removing or drying said mixture.

9. A coated metal container as claimed in claim 8 wherein said lubricant mixture contains about 40% liquid lanolin, about 50% n-butyl stearate and about 10% of G.E. silicone resin SR-82.

10. A coated metal container as claimed in claim 8 wherein said lubricant mixture contains about 17% liquid lanolin, about 67% n-butyl stearate and about 16% of GE silicone resin SR-82.

11. A coated metal container as claimed in claim 9 wherein said synthetic resin overcoat is selected from the group consisting of polyester, acrylic and vinyl resins.

12. A coated metal container as claimed in claim 8 wherein said synthetic resin overcoat is selected from the group consisting of polyester, acrylic and vinyl resins.

13. A coated steel seamless container produced by a method comprising the steps of applying a lubricant mixture consisting essentially of liquid lanolin, n-butyl stearate and a silicone resin to precoated steel or precoated or uncoated tinplated steel providing a circular flat blank from said steel bearing said lubricant mixture on its surfaces, subjecting said blank to multiple drawing steps to form a container without drying or removing said lubricant mixture, overcoating at least the interior surfaces of said container with a synthetic resin selected from the group of epoxy, polyester, acrylic and vinyl resins, and heating said coated container to harden said coating and adhere it to said container walls.

14. A coated container as claimed in claim 13 wherein said mixture consists essentially of about 40% liquid lanolin, about 50% n-butyl stearate and about 10% silicone resin.

15. A coated container as claimed in claim 14 wherein said steel is basecoated with a polyester, vinyl, epoxy or acrylic resin prior to applyin said mixture.

16. A coated steel seamless container produced from a method comprising the steps of applying a vinyl resin to TFS-CT or tinplated steel, subjecting said coated steel to elevated temperature to cure said coating thereon, applying a mixture consisting essentially of liquid lanolin, n-butyl stearate and about 10% GE silicone resin to said coated steel, forming a circular flat blank from said coated metal bearing said mixture, drawing said blank into a shallow cup, subjecting said cup to multiple drawing steps to form a container; without drying or removing said mixture, applying a vinyl resin coating over at least the interior surfaces of said container and subjecting said container to elevated temperature to harden said coating and adhere it to at least said container interior.

17. A coated container as claimed in claim 13 wherein said blank is subjected to ironing during said drawing steps whereby the side wall of said container is thinner than the bottom wall.

18. A coated container as claimed in claim 16 wherein said blank is subjected to ironing during said drawing steps whereby the side wall of said container is thinner than the bottom wall of said container.

* * * * *